US009051724B2

(12) United States Patent
Andoh et al.

(10) Patent No.: US 9,051,724 B2
(45) Date of Patent: Jun. 9, 2015

(54) FLOW REGULATING DEVICE

(75) Inventors: Robert Yaw Gyamfi Andoh, South Portland, ME (US); Jeremy Fink, Portland, ME (US); Scott Bois, Steep Falls, ME (US); Kwabena Osei, South Portland, ME (US)

(73) Assignee: Hydro International plc, Clevedon (GB)

( * ) Notice: Subject to any disclaimer, the term of this patent is extended or adjusted under 35 U.S.C. 154(b) by 663 days.

(21) Appl. No.: 13/085,018

(22) Filed: Apr. 12, 2011

(65) Prior Publication Data

US 2012/0261012 A1 Oct. 18, 2012

(51) Int. Cl.

| | |
|---|---|
| ***F15C 1/16*** | (2006.01) |
| ***E03F 5/10*** | (2006.01) |
| ***F15D 1/00*** | (2006.01) |

(52) U.S. Cl.

CPC ..... *E03F 5/106* (2013.01); *F15D 1/0015* (2013.01)

(58) Field of Classification Search

CPC ..... F16K 21/00; E03F 5/106; F15D 1/0015; F15C 1/16

USPC ..... 405/39, 80; 137/809–812, 613; 138/39, 138/40

See application file for complete search history.

(56) References Cited

U.S. PATENT DOCUMENTS

| | | | | |
|---|---|---|---|---|
| 3,496,961 | A * | 2/1970 | Erwin | 137/812 |
| 3,538,934 | A * | 11/1970 | Erwin et al. | 137/812 |
| 3,608,571 | A * | 9/1971 | Wilcox | 137/809 |
| 4,929,088 | A * | 5/1990 | Smith | 366/337 |
| 5,303,782 | A | 4/1994 | Johannessen | |
| 5,505,229 | A * | 4/1996 | Lee, II | 138/40 |
| 6,374,858 | B1 | 4/2002 | Hides et al. | |
| 2007/0028977 | A1 * | 2/2007 | Goulet | 137/809 |

FOREIGN PATENT DOCUMENTS

| | | |
|---|---|---|
| DE | 26 43 029 | 3/1978 |
| DE | 10 2008 019 930 | 10/2008 |

OTHER PUBLICATIONS

International Search Report for International Application No. PCT/GB2012/050698, Jun. 21, 2012, European Patent Office, Rijswijk, Netherlands.

* cited by examiner

*Primary Examiner* — Craig Schneider
*Assistant Examiner* — Minh Le
(74) *Attorney, Agent, or Firm* — Marvin Petry; Stites & Harbison PLLC

(57) ABSTRACT

A flow regulating device 2 comprising a plurality of coaxial vortex chambers 16, 116, 216, 316 disposed in flow series. Each vortex chamber 16, 116, 216, 316 has an inlet 22, 122, 222, 322 disposed to promote rotational flow within the vortex chamber 16, 116, 216, 316, and an outlet 24, 124, 224, 324. A diffusion chamber 12, 112, 212 is disposed between adjacent vortex chambers 16, 116, 216, 316, and the outlet 24, 124, 224, 324 of one and the inlet 22, 122, 222, 322 of the other of the adjacent vortex chambers 16, 116, 216, 316 open into the diffusion chamber 12, 112, 212.

9 Claims, 3 Drawing Sheets

FLOW REGULATING DEVICE

FIELD OF THE INVENTION

This invention relates to a flow regulating device, and particularly, although not exclusively, relates to a device for regulating stormwater flow in a stormwater system.

BACKGROUND OF THE INVENTION AND PRIOR ART

It is known that vortex valves can be used to regulate stormwater flow. For example, WO99/43899 discloses a vortex valve for regulating stormwater flow comprising a vortex chamber defined by a circular cylindrical wall and two axial end walls. The vortex chamber has an outlet through one end wall and an inlet arranged to cause swirl in the chamber when a certain critical flow has been attained.

At low flow rates, water entering through the inlet of a vortex valve passes through the vortex chamber to the outlet with substantially no pressure drop, and the valve can be considered to be open. At high flow rates, water enters through the inlet with enough energy to create a vortex in the vortex chamber which results in a significant pressure drop between the inlet and the outlet. The pressure drop generates an air-filled core at the center of the vortex which restricts flow through the outlet, and can even substantially cut it off altogether. The valve thus limits the rate of flow through the valve automatically. Vortex valves can be used, for example, to control the flow of stormwater in sewers so that equipment downstream of the valve is not overloaded during periods of heavy rainfall.

The performance of a vortex valve under particular flow conditions is dictated by the geometry of the vortex valve, for example the size of the inlet or outlet, or the diameter of the vortex chamber.

An important characteristic of a vortex valve is the relationship between the pressure head across the valve and the flow rate through the valve. The required characteristic is commonly specified by the customer. If a fixed geometry vortex valve is to be provided, the customer's requirement can sometimes call for the outlet of the vortex valve to have a relatively small diameter, which may be subject to blockage by debris entrained in the flow through the vortex valve. An increase in the diameter of the outlet to reduce the risk of blockage will increase the flow rate through the valve under storm conditions, and this may not be acceptable.

Also where a vortex valve is installed with standard pipe fittings, or retrofitted into an existing drainage system, the inlet/outlet of the valve must be sized to accommodate the diameter of the pipes to which the valve is connected. Consequently, in order to deliver the required performance, the geometry of the vortex chamber other than the inlet/outlet diameter, for example the diameter of the vortex chamber, must be designed to meet performance requirements. Vortex valves are thus often designed on an ad hoc basis for specific applications.

Furthermore, where the geometry of the valve is constrained by the inlet and outlet diameter requirements, the space in which the valve is fitted often has to be adapted to accommodate the valve. This is both costly and time consuming.

SUMMARY OF THE INVENTION

According to a first aspect of the invention there is provided a flow regulating device comprising a plurality of coaxial vortex chambers disposed in flow series, each vortex chamber having an inlet disposed to promote rotational flow within the vortex chamber, and an outlet, a respective diffusion chamber being disposed between each two adjacent vortex chambers, whereby the outlet of one and the inlet of the other of the two adjacent vortex chambers open into the diffusion chamber.

The vortex chambers may be disposed in a common duct, wherein each vortex chamber may comprise a housing having a circumferential outer wall and first and second end walls, one of the end walls comprising a partition which extends across the duct, the outlet of the respective vortex chamber being formed in the partition.

Adjacent ones of the partitions may define the respective diffusion chambers.

The flow regulating device may further comprise a common duct provided with spaced apart partitions extending across the duct, alternate partitions having vortex chamber inlets and vortex chamber outlets whereby each vortex chamber is defined between an upstream partition having a vortex chamber inlet and a downstream partition having a vortex chamber outlet, and each diffusion chamber is defined between an upstream partition having a vortex chamber outlet and a downstream partition having a vortex chamber inlet.

The duct may comprise a circumferential outer wall and the vortex chamber inlets are adjacent the circumferential outer wall.

Each vortex chamber inlet may comprise a notch at the periphery of the upstream partition.

The upstream partition of each vortex chamber may be inclined in the downstream direction in the region of the inlet aperture so as to promote rotational flow within the vortex chamber.

The plurality of coaxial vortex chambers may comprise at least three vortex chambers.

According to a second aspect of the invention there is provided a stormwater system including a device for regulating stormwater flow in the system, the device comprising a flow regulating device comprising a plurality of coaxial vortex chambers disposed in flow series, each vortex chamber having an inlet disposed to promote rotational flow within the vortex chamber, and an outlet, a respective diffusion chamber being disposed between each two adjacent vortex chambers, whereby the outlet of one and the inlet of the other of the two adjacent vortex chambers open into the diffusion chamber.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE PREFERRED EMBODIMENT

Figure 1:
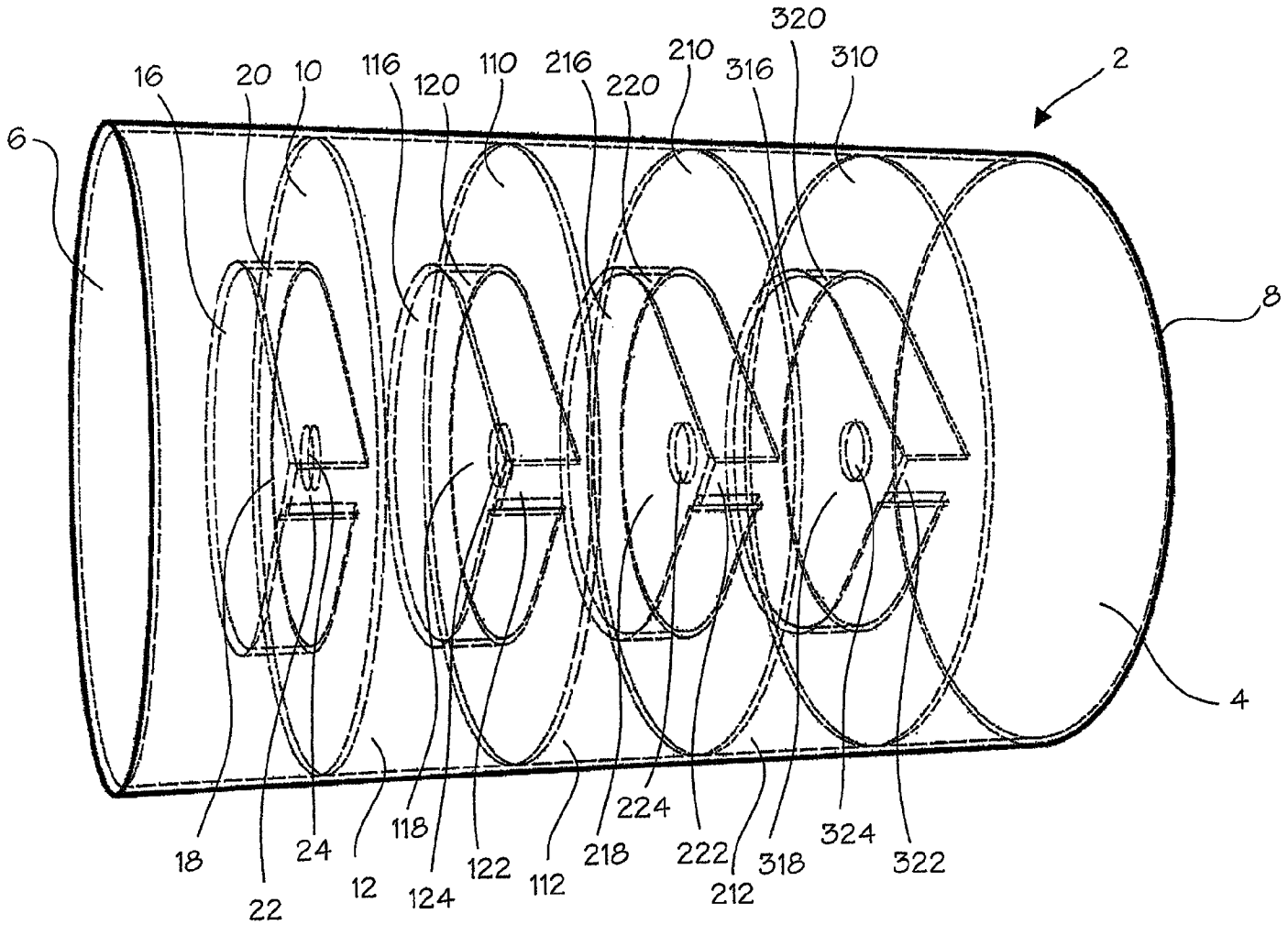
FIG. 1 is a schematic representation of a first embodiment of a device for regulating stormwater flow.

FIG. 1 shows a first embodiment of a flow regulating device 2 for regulating stormwater flow through a stormwater system. The device 2 comprises a duct in the form of a cylindrical casing 4, the inside of which cylinder is of uniform cross-section which is open at each end. The open ends respectively define a device inlet 6 and a device outlet 8. In use, the general direction of flow from the inlet 6 towards the outlet 8 defines the downstream direction.

Circular partition discs 10, 110, 210, 310 are spaced equally along the length of the casing 4 and partition the casing 4 into diffusion chambers 12, 112, 212. The diffusion chambers 12, 112, 212 are thus defined between adjacent partition discs 10, 110, 210, 310 and the casing 4. In the embodiment shown in FIG. 1, there are four partition discs 10, 110, 210, 310 which define three diffusion chambers 12, 112, 212 between adjacent discs 10, 110, 210, 310.

A vortex chamber 16, 116, 216, 316 is disposed at the upstream surface of each partition disc 10, 110, 210, 310. Each vortex chamber 16, 116, 216, 316 is defined by an end wall, also referred to as a top wall, 18, 118, 218, 318 and a circumferential outer wall 20, 120, 220, 320 which extends about the periphery of the end wall 18, 118, 218, 318, and joins the end wall 18, 118, 218, 318 to the upstream surface of the corresponding partition disc 10, 110, 210, 310. Each partition disc 10, 110, 210, 310 thus forms an opposite end wall of a vortex chamber 16, 116, 216, 316. Each vortex chamber 16, 116, 216, 316 is substantially cylindrical and has a longitudinal axis which is coaxial with the axes of the other vortex chambers and coaxial with the longitudinal axis of the cylindrical casing 4.

A vortex chamber inlet 22, 122, 222, 322 is provided through the circumferential outer wall 20, 120, 220, 320. A portion of the outer wall 20, 120, 220, 320 extends tangentially with respect to the vortex chamber 16, 116, 216, 316 adjacent the inlet 22, 122, 222, 322 so as to guide flow in a tangential direction through the inlet 22, 122, 222, 322. A vortex chamber outlet 24, 124, 224, 324 is provided through the center of each partition disc 10, 110, 210, 310.

The internal diameter of each vortex chamber 16, 116, 216, 316 is smaller than the internal diameter of the cylindrical casing 4 in the region within which the vortex chamber 16, 116, 216, 316 is disposed. The vortex chambers 16, 116, 216, 316 are connected in series by the respective diffusion chambers 12, 112, 212.

In use, water enters the flow regulating device 2 through the device inlet 6 and flows through the successive vortex chambers 16, 116, 216, 316 and corresponding diffusion chambers 12, 112, 212 before being discharged through the device outlet 8.

At low flow rates, the level of water rises in the region between the device inlet 6 and the first partition disc 10, and in the first vortex chamber 16, until the water overflows the edge of the vortex chamber outlet 24 into the diffusion chamber 12. Continued flow causes successive overflow of the water through the vortex chamber outlets 124, 224, 324 so that the water reaches the device outlet 8. The water thus flows through each of the successive vortex chambers 16, 116, 216, 316 and diffusion chambers 12, 112, 212 with substantially no pressure drop.

As the pressure head of the water at the device inlet 6 increases, the flow rate through the first vortex chamber inlet 22 correspondingly increases. At a predetermined pressure head determined by the design of the first vortex chamber 16, the flow rate through the first vortex chamber inlet 22 will be sufficient to generate a circulating flow, or vortex, around the outer wall 20 of the first vortex chamber 16. This is assisted by the tangential arrangement of the vortex chamber inlet 22, which promotes rotational flow within the vortex chamber 16. The high velocities of the vortex reduce the static pressure at the center of the vortex thereby creating an air core at the center of the vortex. The center of the vortex forms at the vortex chamber outlet 24 and so creates a pressure drop between the inlet 22 and the outlet 24. The presence of an air core reduces the effective flow area of the vortex chamber outlet 24 and so restricts flow of water through the vortex chamber outlet 24. This significantly reduces the flow rate through the vortex chamber outlet 24 into the diffusion chamber 12, and increases the pressure drop across the first vortex chamber 16.

The water is discharged through the vortex chamber outlet 24 at a reduced pressure into the diffusion chamber 12 immediately downstream of the vortex chamber outlet 24. As the water disperses within the diffusion chamber 12, the rotational and axial flow velocities reduce. When the vortex in the first vortex chamber 16 first initiates, the resulting flow rate into the first diffusion chamber 12, and thence through the inlet 122 of the second vortex chamber 116 may not be sufficient to generate a vortex in the second vortex chamber 116. Consequently, the pressure drop across the second vortex chamber 116, and the subsequent vortex chambers 216, 316 may remain low.

A further increase in pressure head at the device inlet 6 will increase flow through the first vortex chamber 16, and into the first diffusion chamber 12, sufficiently to cause a vortex to be generated in the second vortex chamber 116, so providing a further flow rate reduction and overall pressure drop. Further increases in pressure head will likewise cause vortices to be generated successively in the third and fourth vortex chamber 216, 316. The reduction in pressure at each outlet 124, 224, 324 further inhibits flow through the device 2. Thus, the vortex generated in each successive vortex chamber 16, 216, 316 contributes to a reduction in the flow rate through the device 2. The resultant flow rate and pressure drop through the flow regulating device 2 is dependent on the number of vortex chambers 16, 116, 216, 316 constituting the device 2.

Figure 3:
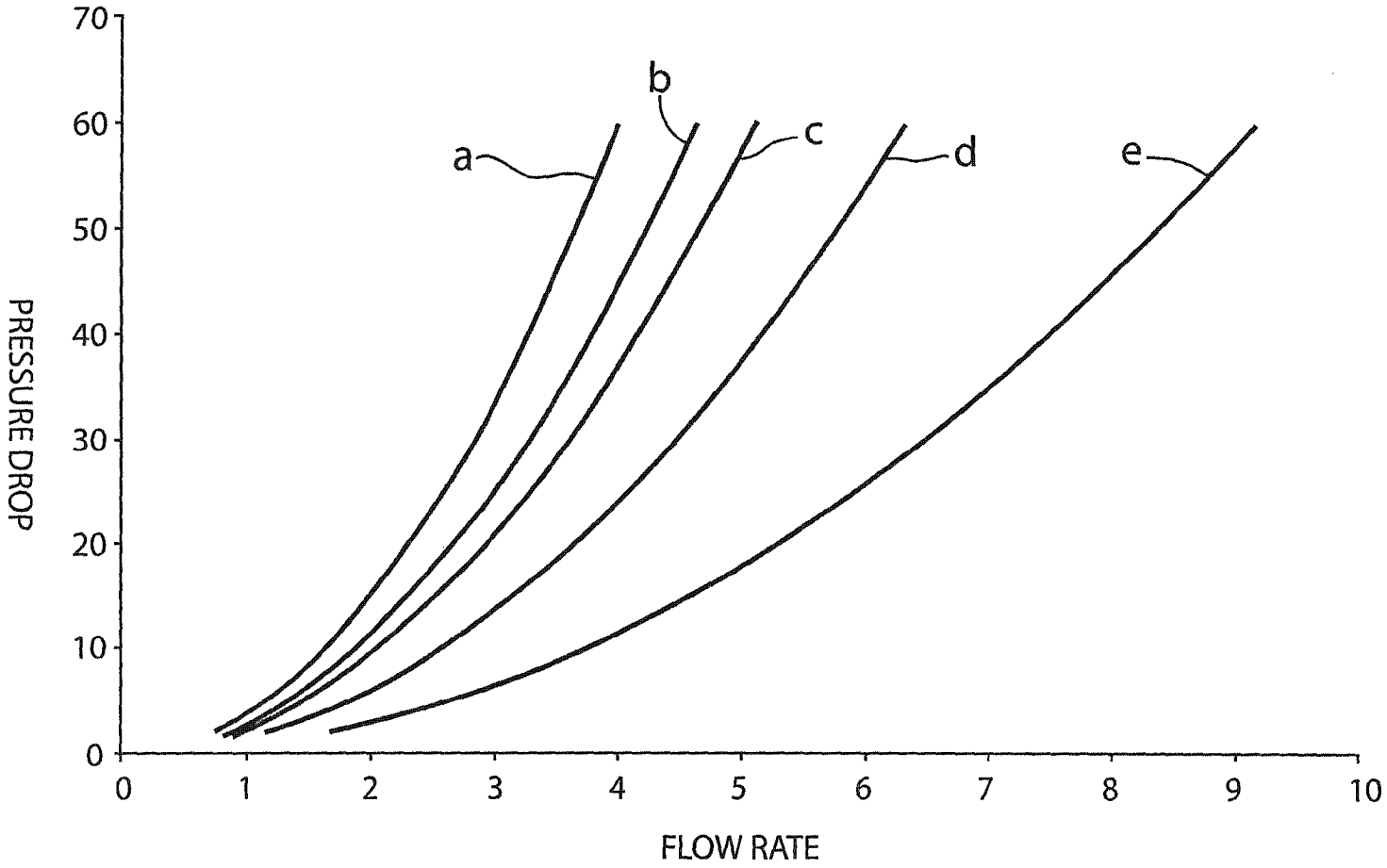
FIG. 3 is a graphical representation of performance characteristics of a stormwater flow device provided with different numbers of vortex chambers.

A desired pressure drop characteristic or flow restriction through the flow regulating device 2 can be achieved by varying the number of vortex chambers 16, 116, 216, 316 which constitute the device 2 without having to vary the diameter of the cylindrical casing 4 or the diameter of device inlet 6 or device outlet 8. A graphical illustration of pressure drop across the flow regulating device 2 (vertical axis) against flow rate through the flow regulating device 2 (horizontal axis) is shown in FIG. 3 for a flow regulating device 2 provided with a different number of vortex chambers 16, 116, 216, 316. It can be seen that, for a particular flow rate, increasing the number of vortex chambers 16, 116, 216, 316 increases the pressure drop across the flow regulating device 2.

The flow regulating device 2 shown in FIG. 1 achieves an overall flow rate reduction at higher inlet pressure heads comparable to that of a single chamber vortex valve having an outlet smaller than any of the vortex chamber outlets 24, 124, 224, 324. The vortex valve outlets 24, 124, 224, 324 are each larger than the single outlet of a comparable single chamber vortex valve and so are less likely to be blocked by debris passing through the flow regulating device 2.

Figure 2:
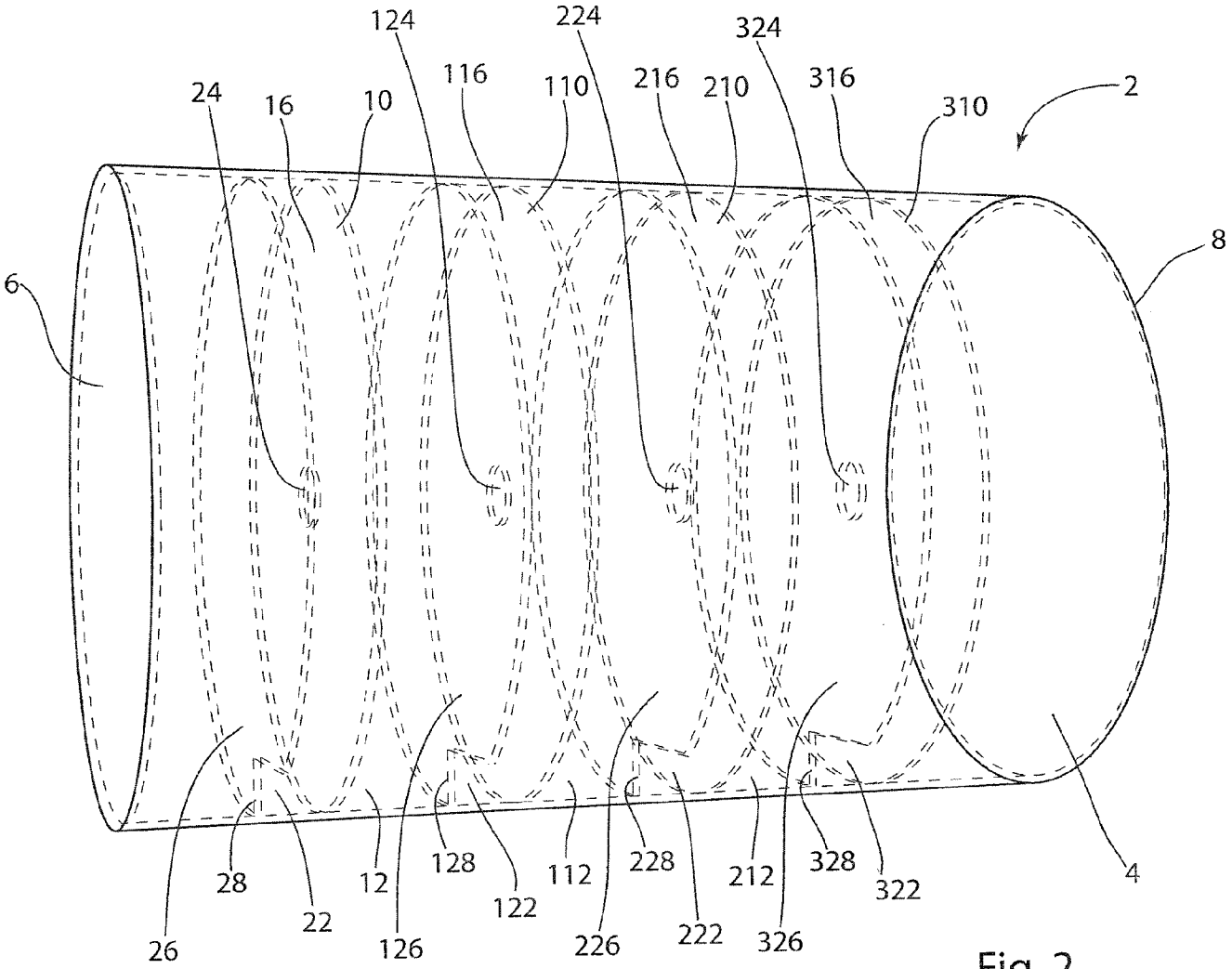
FIG. 2 is a schematic representation of a second embodiment of a device for regulating stormwater flow.

A second embodiment of the flow regulating device 2 is shown in FIG. 2. Those aspects of the device 2 which differ from that shown in FIG. 1 will be described.

Control discs 26, 126, 226, 326 are interposed between the partition discs 10, 110, 210, 310. The control discs further partition the cylindrical casing 4 along its length. The vortex chambers 16, 116, 216, 316 are defined between each control disc 26, 126, 226, 326 and a partition disc 10, 110, 210, 310 which is downstream of, and adjacent to, the control disc 26, 126, 226, 326. Thus, instead of a separately defined vortex chamber as described in the first embodiment, the second embodiment has vortex chambers 16, 116, 216, 316 defined between respective control discs 26, 126, 226, 326, partition discs 10, 110, 210 and the cylindrical casing 4.

Each vortex chamber inlet 22, 122, 222, 322 comprises a notch 28, 128, 228, 328 in the periphery of the control disc 26, 126, 226, 326. The notch 28 may, for example, be a cut-out segment at the periphery of the control disc 26, 126, 226, 326 having orthogonal edges which extend along respective chords of each control disc 26, 126, 226, 326. The major part of the area of each control disc 26, 126, 226, 326 lies in a plane transverse to the axis of the casing 4. However, the upstream surface of each control disc 26, 126, 226, 326 adjacent the notch 28, 128, 228, 328 is inclined with respect to that transverse plane so as to promote rotational flow in the vortex chamber 16, 116, 216, 316. For example, the region of each control disc near the notch 28, 128, 228, 328 may be deflected in the downstream direction.

The variant shown in FIG. 2 is simple to manufacture, assemble and/or modify. For example, a prefabricated casing 4 can be adapted so that control discs 26, 126, 226, 326 and partition discs 10, 110, 210, 310 can be added or removed to modify the performance characteristics of the flow regulating device 2.

In use, the upstream static pressure of water entering the inlet 6 may, for example, be between 7000 and 8500 Pa. When vortices have initiated within all of the vortex chambers 16, 116, 216, 316, the pressure in the first diffusion chamber 12 is between 5000 Pa and 6000 Pa. The pressure in the second diffusion chamber 112 is between 3000 Pa and 4500 Pa. The pressure in the third diffusion chamber 212 is between 1100 Pa and 2500 Pa. The pressure at the device outlet 8 is between 100 Pa and 700 Pa. It will be appreciated that the absolute static pressures within the diffusion chambers 12, 112, 212 and pressure drops across each vortex chamber 16, 116, 216, 316 are dependent on the pressure of the in flowing water and the performance characteristics of the individual vortex chambers 16, 116, 216, 316.

In the embodiments of FIGS. 1 and 2, each partition and the vortex chamber disposed at its upstream surface may be referred to as an assembly. Each diffusion chamber extends completely across the interior of the duct so as to form a free space which physically separates each assembly from its adjacent upstream assembly. For example, in FIG. 1 each assembly comprises a partition 10, 110, etc. and a vortex chamber formed by 16, 116, etc., the vortex chamber having a circumferential outer wall formed by 20, 120, etc., a top wall 18, 118, etc., and a bottom wall which is a portion of the partition 10, 110 located within the boundary of the circumferential outer wall 20, 120, etc. In FIG. 2, each assembly comprises a partition 10, 110, etc. and a vortex chamber, the vortex chamber having a circumferential outer wall formed by the inside wall of duct 4, a top wall formed by an upstream control disc 26, 126, etc. and a bottom wall which is the entire portion of the partition 10, 110, etc. located within the boundary of the outer wall duct 4.

Each of the variants described above can be modular; that is, vortex chambers and diffusion chambers can be constructed as modular components which can be added or removed to change the flow characteristics of the flow regulator. For example, the flow regulating device can be configured to deliver a required performance by the addition or removal of vortex chambers. The performance characteristics of a flow regulating device comprising two, three, four or more modular components can be calibrated. Referring for example to FIG. 3, line "a" shows pressure drop versus flow rate for four valves, line "b" shows the same for three valves, line "c" shows the same for two valves and "d shows the same for one valve. Line "e" shows the pressure drop versus flow rate at the orifice. Flow regulating devices having a particular number of modular devices can therefore be assembled to satisfy particular performance requirements.

The partition discs shown in FIG. 1 and/or the control discs shown in FIG. 2 may be spaced from each other at different distances to define vortex chambers and/or diffusion chambers which differ in volume from other vortex chambers/diffusion chambers of the flow regulating device.

The flow areas of the outlets of the vortex chambers may be the same. However, the flow area of the outlet of each successive vortex chamber may be less than, or greater than, the flow area of the outlet, or outlets, of at least one, or all, of the upstream vortex chambers. For example, the flow areas of the outlets of the vortex chambers may be sized so that they decrease from the device inlet towards the device inlet such that the most downstream vortex chamber is the first to initiate, the remaining vortex chambers initiating successively in the upstream direction. The initiation sequence may also be determined by varying the coefficient of drag (Cd) of each of the vortex chambers.

A flow regulating device as described above is particularly suitable for use in regulating relatively low flow rate stormwater flows. For instance, such a device would be suitable for flow systems in which the size of a single valve which would achieve an equivalent flow restriction would be unfeasible due to the likelihood of blockage. By assembling the device from appropriate components, the flow characteristic of the device can be tailored to specific circumstances.

We claim:

1. A flow regulating device comprising;

a duct, the inside of which is formed as a cylinder of uniform cross-section, a plurality of assemblies located in flow series in the duct, each assembly comprising a partition which extends across the entire cross-section of the inside of the duct and a vortex chamber disposed at the upstream surface of its respective partition, the assemblies being arranged such that the vortex chambers of the assemblies are coaxial, each vortex chamber comprising a circumferential outer wall, a top wall covering the top of the vortex chamber within the boundary of the outer wall and a bottom which is a portion of the partition located within the boundary of the outer wall, each vortex chamber having an inlet and an outlet, the inlet disposed to promote rotational flow within the vortex chamber and the outlet being located in its said bottom, and a diffusion chamber disposed between the partition of one assembly and the vortex chamber of the next downstream assembly, the diffusion chambers extending completely across the inside of the duct so as to form a free space which physically separates each assembly from its adjacent upstream assembly.

2. A flow regulating device according to claim 1, wherein the circumferential wall is spaced inwardly from the inside of the duct and the inlet to the vortex chamber is through the circumferential outer wall.

3. A flow regulating device according to claim 1, comprising at least three assemblies.

4. A flow regulating device according to claim 1, wherein the top wall extends completely across the cross section of the inside of the duct and the circumferential wall is formed by the inside wall of the duct between the top wall and the bottom of the vortex chamber.

5. A flow regulating device according to claim 1, in which the partition of one assembly and the top wall of the next adjacent downstream assembly form the diffusion chamber.

6. A flow regulating device according to claim 5, in which the vortex chamber inlets are formed in the top wall adjacent to the inside wall of the duct.

7. A flow regulating device according to claim 5, which each vortex chamber inlet comprises a notch at the periphery of the top wall.

8. A flow regulating device according to claim 5, in which the top wall of each vortex chamber is inclined in the downstream direction in the region of the inlet to promote rotational flow within the vortex chamber.

9. A storm water system including a device for regulating storm water flow in the system, the device comprising a duct, the inside of the duct formed as a cylinder of uniform cross-section, and a flow regulating device, comprising;

a plurality of assemblies located in flow series in the duct, each assembly comprising a partition which extends across the entire cross-section of the inside of the duct and a vortex chamber disposed at the upstream surface of its respective partition, the assemblies being arranged such that the vortex chambers of the assemblies are coaxial, each vortex chamber comprising a circumferential outer wall, a top wall covering the top of the vortex chamber within the boundary of the outer wall and a bottom which is a portion of the partition located within the boundary of the outer wall, each vortex chamber having an inlet and an outlet, the inlet disposed to promote rotational flow within the vortex chamber and the outlet being located in its said bottom, and a diffusion chamber disposed between the partition of one assembly and the vortex chamber of the next downstream assembly, the diffusion chambers extending completely across the inside of the duct so as to form a free space which physically separates each assembly from its adjacent upstream assembly.

* * * * *